US005423702A

United States Patent [19]

Butler

[11] Patent Number: 5,423,702

[45] Date of Patent: Jun. 13, 1995

[54] FUEL TANK SUMP ASSEMBLY FOR FUEL INJECTION ENGINES

[75] Inventor: David L. Butler, Sparta, Tenn.

[73] Assignee: Moeller Marine Products, Goodlettsville, Tenn.

[21] Appl. No.: 100,060

[22] Filed: Jul. 30, 1993

[51] Int. Cl.[6] ..... B63H 21/10

[52] U.S. Cl. ..... 440/88; 220/4.014

[58] Field of Search ..... 440/88; 220/4.12–4.15, 220/562–564; 137/576; 123/514

[56] References Cited

U.S. PATENT DOCUMENTS

| | | | |
|---|---|---|---|
| 4,776,483 | 10/1988 | Currey | 220/327 |
| 4,869,225 | 9/1989 | Nagata et al. | 123/514 |
| 5,221,021 | 6/1993 | Danna | 220/563 |

*Primary Examiner*—Edwin L. Swinehart
*Attorney, Agent, or Firm*—Howard & Howard

[57] ABSTRACT

The present invention relates to modified fuel tanks for use in watercrafts and, in particular, to the use of a fuel cell in a fuel tank to concentrate fuel about the fuel intake line to prevent air from entering the fuel intake line due to shifting of fuel within the fuel tank. The fuel cell includes a body portion having four walls defining a rectangular inner chamber. Apertures, preferably square apertures, are formed in the port and starboard walls of the fuel cell. These permit fuel to enter the fuel cell as the fuel shifts within the tank. Additionally, at least one small aperture is formed adjacent the base of the fuel cell to ensure that the level of fuel in the fuel cell is always at least equal to the level of fuel in the fuel tank. Inner and outer mounting plates are used to mount the fuel cell to a standard fuel tank. The outer mounting plate is also adapted to receive fuel intake and return lines, as well as fuel gauges.

16 Claims, 2 Drawing Sheets

FUEL TANK SUMP ASSEMBLY FOR FUEL INJECTION ENGINES

BACKGROUND

The present invention relates to a modified fuel tank for use in watercrafts, particularly boats that have fuel injected engines.

Fuel injected marine engines are becoming more popular with boaters and boat manufacturers. Fuel injected marine engines are popular because they are more economical to operate. They require less fuel and less maintenance. They are also faster than normal air aspirated marine engines.

Although popular, fuel injected marine engines have the disadvantage of pulling air into the fuel lines when the boat makes sharp turns. During a sharp turn, the fuel in the fuel tank shifts and depending upon the amount of fuel, the fuel intake line can draw in air. Air in the intake line will cause the boat engine to hesitate and many times may cause the boat to stall. Air aspirated engines do not suffer from this problem because the carburetor expels the air.

In non-marine fuel injected engines, a fuel pump within the fuel tank is provided to pump fuel to the engine and insure that no air enters the fuel intake line. Tank fuel pumps, however, cannot be used in marine engines. The main reason for this restriction is the potential that the fuel lines may leak or the fuel pump may malfunction, pumping fuel into the boat.

SUMMARY OF THE INVENTION

The present invention overcomes the problem encountered in fuel injected boats. The present invention generally relates to a modified fuel tank for use in boats that have fuel injected engines.

The fuel tank of the present invention includes a fuel cell that is designed to hold sufficient fuel regardless of the orientation of the remaining fuel in the fuel tank. The fuel cell includes a tubular portion that extends into the fuel tank and receives fuel from the fuel tank and the return line from the fuel injected engine.

The tubular portion has a closed end and four walls defining a generally rectangular interior chamber. The walls of the tubular portion are generally aligned with the fore, aft, starboard, and port sides of the boat. The starboard and port sides of the fuel cell each have an aperture that receives fuel from within the fuel tank with the fuel being retained within the fuel cell. In the preferred embodiment, the apertures are square. There is also at least one opening in the fore wall for communicating fuel into the fuel cell. All fuel is drawn from the fuel cell, and in the preferred embodiment, unburned fuel is returned to the fuel cell. In this way, the fuel cell maintains a sufficient supply of fuel to supply the fuel pick-up line, and shifting fluid in the fuel tank does not affect the supply of fuel to the pick-up line.

In the preferred embodiment, the fuel cell is a separate unit that is mounted by a mounting assembly within the fuel tank. The mounting assembly includes an inner mounting plate or mounting ring which is mounted to the inside of the fuel tank along the edge of an opening formed in the fuel tank. An outer mounting plate is adapted to be mounted to the inner mounting plate. The fuel cell includes a mounting flange which is sandwiched between said inner and outer plates.

DETAILED DESCRIPTION OF THE INVENTION

Figures 1, 2:
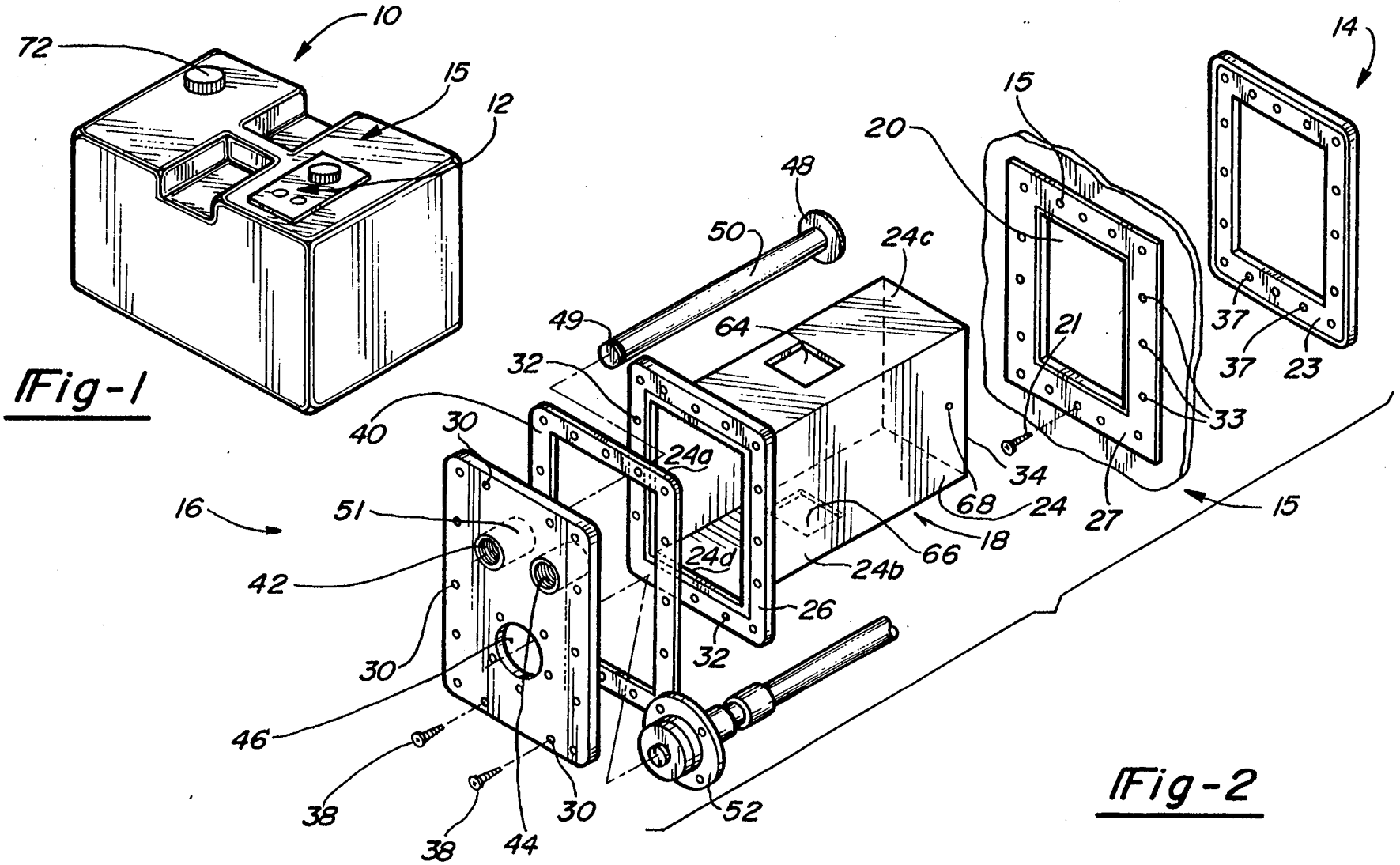
FIG. 1 is a perspective view of the fuel tank of the present invention.
FIG. 2 is a perspective exploded view of the fuel cell of the present invention.
Figure 3:
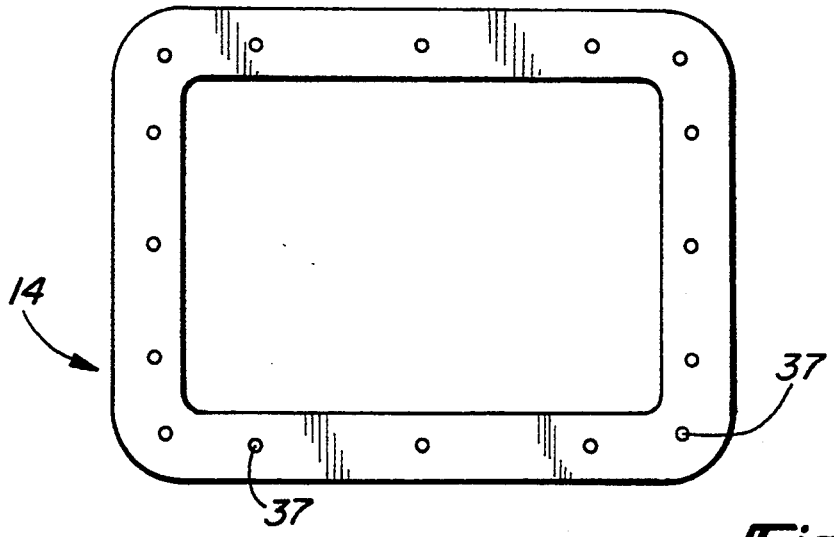
FIG. 3 is a plan view of the inner mounting plate.

With reference to FIG. 1, the fuel tank of the present invention is shown generally at 10. Fuel tank 10 includes a fuel tank access plate 12. With reference to FIG. 2, in the preferred embodiment, access plate 12 includes an inner plate or mounting ring 14 and an outer plate 16. The inner plate 14 is adapted to be mounted to the inner surface of the top 15 of the fuel tank 10, and outer plate 16 is adapted to be mounted to plate 14 against the outer surface of top 15. A sump assembly or fuel cell 18 is adapted to be mounted to the fuel tank by being sandwiched between the inner plate 14 and outer plate 16. In the preferred embodiment, the fuel cell is made from cross-link plastic and molded by rotational molding. The inner and outer plates are made of cross-link plastic and injection molded.

The top 15 of fuel tank 10 has an opening 20 which corresponds to the opening in the inner plate 14. The inner plate 14 is fastened to the inner surface of top 15 by flathead screws 21 to form a support plate. A seal 23 can be employed between plate 14 and the inner surface of top 15. This seal can be a rubber seal, or as disclosed in U.S. Pat. No. 4,776,483, the inner plate can have ridges which are urged into sealing engagement with the fuel tank. Other methods of sealing are also considered to be within the scope of this invention and will be well known to those of ordinary skill in the art.

The fuel cell 18 is inserted into the opening 20 and through the inner plate 14. The fuel cell 18 preferably includes a body portion 24 and a mounting flange 26. The mounting flange 26 abuts against top 15. In the preferred embodiment, a seal 27, for example a rubber seal, is provided between the flange 26 and surface 15 to provide a seal between these members.

As can be seen in FIG. 2, the body portion 24 includes four walls **24*a*, 24*b*, 24*c* and 24*d*. Walls 24*a* and 24*b* are positioned on the fore and aft sides of the boat and walls 24*c* and 24*d* are positioned on the starboard and port side of the boat. The bottom of body portion 24 is closed by a bottom wall 34. Openings 64 and 66 are provided in sidewalls 24*c* and 24*d* and in the disclosed embodiment, a small opening 68 is formed in sidewall 24*b***.

Figure 4:
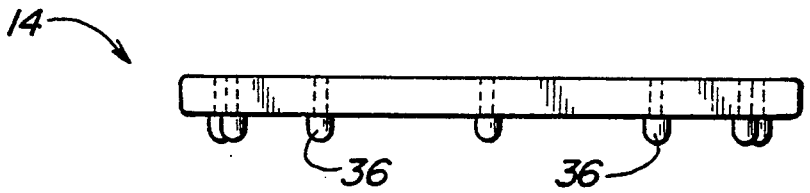
FIG. 4 is a side view of the inner mounting plate.

The outer plate 16 is mounted against the mounting flange 26. In the preferred embodiment, stainless steel self-tapping screws 38 are screwed into peripheral openings 30 in outer plate 16 through peripheral openings 32 in flange 26, through peripheral openings 33 in surface 15 and into peripheral openings 37 in inner plate 14. In order to provide sufficient surface area for receipt of the self-tapping screws, the openings 37 in inner plate 14 are closed by bulbous portions 36 into which the self-tapping screws 38 can be screwed. See FIG. 4. In the preferred embodiment a seal 40, such as for example a rubber seal, is provided between outer plate 16 and flange 26.

Figure 5:
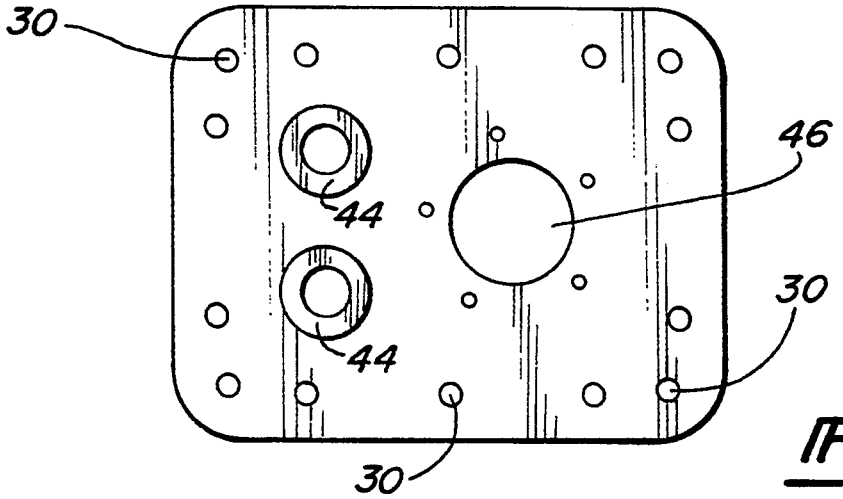
FIG. 5 is a top view of the outer plate.
Figure 6:
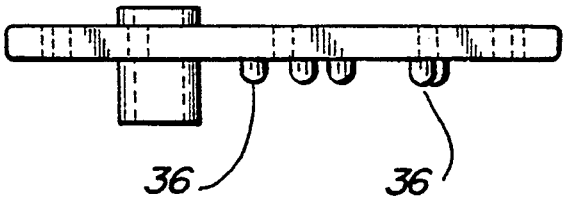
FIG. 6 is a side view of the outer plate.

As seen in FIGS. 2 and 5, in the preferred embodiment, there are three apertures 42, 44 and 46 formed in cover plate 16. Aperture 42 is adapted to receive a fuel pick-up tube 50, which is connected to the fuel injected engine. As is typical, tube 50 includes a screen 48 and has a threaded end portion 49 which can be threaded into the nipple 51 extending from cover plate 16. The pick-up tube 50 extends into the interior of fuel cell 18 until it is adjacent the bottom wall 34 of cell 18. In this way, pick-up tube 50 is adapted to pick-up substantially all of the fuel in fuel cell 18. Aperture 44 is adapted to receive a fuel return line for returning unburned fuel from the fuel injection engine to the fuel cell 18. Aperture 46 is adapted to receive a fuel indicator 52. As will be appreciated by those of ordinary skill in the art, fuel indicator 52 is used to indicate the quantity of fuel remaining in the fuel tank and in particular the fuel cell 18. As can be seen in FIG. 6, the aperture 46 has openings 37 with bulbous portions 36 to permit self-tapping screws to be used.

As can be seen in FIG. 2, starboard and port walls 24*c* and 24*d* each have an opening 64 and 66 respectively. Preferably, the openings 64 and 66 are generally square. It is preferable that the fuel cell have four fiat walls with two generally square openings in opposite walls on the starboard and port sides of the boat. In this way, as the boat takes sharp turns, either to port or starboard, the fuel in the tank splashes against the side walls 24*c* and 24*d* and fuel is forced into openings 64 and 66 filling the interior of fuel cell 18. Additionally, a small aperture 68 is formed near the base 34 to insure that the level of fuel in the fuel cell is always at least at the same level as fuel level in the fuel tank. It will be appreciated by those of ordinary skill in the art that the length of the fuel cell is just slightly less than the depth of the fuel tank so that all available fuel in the fuel tank is available for entry into fuel cell 18. In the preferred embodiment, the openings 64 and 66 are just above the mid-point of the tubular body portion 24.

In operation, the fuel tank is filled at 72 in the normal manner. Due to the openings 64, 66, and 68, the fuel cell 18 will have the same depth of fuel until the fuel depth in fuel tank 10 is below the bottom of openings 64 and 66. At this point, the fuel level in cell 18 will be at least as high as that in the fuel tank and, at times, higher. The fuel injected engine draws fuel through pick-up tube 50 from cell 18 and any excess unburned fuel not used by the engine is returned through a return line to aperture 44 into fuel cell 18. As the fuel level in fuel tank 10 drops below openings 64 and 66, the level of fuel in fuel cell 18 will stay at least equal to the level of fuel in fuel tank 10 due to opening 68, allowing an equalization of the fuel level. If the boat is turned to starboard or port sharply, the fuel in tank 10 will shift to the opposite side of the tank and will splash against walls 24*c* and 24*d* respectively, and spill into opening 64 and 66. It has been found by applicant that the rectangular shape of the tubular body 24 facilitates the entry of the fuel into openings 64 and 66. Additionally, the small cross-sectional area of tubular body 24 reduces the amount of displacement of the fuel in cell 18, particularly as compared to the displacement of fuel in tank 10. These two factors ensure that tube 50 will be submerged in fuel, and the fuel line will not draw air. In this way, the problem of fuel shifting in a fuel tank resulting in air being drawn into the fuel injected engine is eliminated. The concentration of the fuel in the fuel cell 18 with the intake 50 and return tubes fitted within the cell prevents the drawing of air into the engine.

The fuel cell 18 can be attached to a standard fuel tank 10. In the preferred embodiment, a 3 inch by $4\frac{3}{4}$-inch opening 20 is cut into the top 15 of tank 10. The bottom plate 14 is inserted into this opening 20 and secured to the inside top surface 15 of the tank 10 with two stainless steel self-tapping screws 21. The fuel cell 18, with seals affixed on the upper and lower flange surfaces, is then inserted into the opening 20 to which the bottom plate 14 is secured. The top plate 16, with all assembled components, is then assembled on top of the fuel cell 18 and secured in place by, preferably, 14 stainless steel self-tapping screws.

It will be apparent to those of ordinary skill in the art that the above description of this invention is a preferred embodiment and variations of this embodiment are possible. Therefore, the invention should only be limited to the following claims.

What is claimed is:

1. A fuel tank for use in watercrafts having fuel injection engines, said fuel tank comprising:

a chamber mounted within said fuel tank, said chamber having a tubular body portion, said tubular body portion including a base and tour walls defining a generally rectangular cross section, said walls being generally aligned with the fore, aft, starboard, and port sides of said watercraft;

said chamber includes a mounting flange at the end of said tubular body portion opposite said base for mounting said secondary chamber to said fuel tank;

a mounting assembly for mounting said chamber and said fuel pick-up line and fuel return line to said fuel tank said fuel tank including an opening for receipt of said chamber and said fuel lines, said mounting assembly being mounted about said opening and having an inner plate mounted to the interior of said tank about the outer periphery of said opening, and an outer plate mounted to the exterior of said fuel tank about the outer periphery of said opening;

said outer plate having holes for receipt of said fuel lines;

said starboard and port sides of said tubular body including apertures for receiving fuel from within said fuel tank to be retained within said tubular body portion, at least one of said other walls having a small opening adjacent said base for delivery fuel into said tubular body portion;

fuel pick-up and return lines being mounted inside said tubular body portion such that fuel drawn by said engine is drawn from within said tubular body and fuel returned to said fuel tank is returned to said tubular body;

whereby said chamber provides fuel to said engine and maintains a sufficient supply of fuel to supply said pick-up line to prevent air from entering said pick-up line.

2. The fuel tank of claim 1, wherein said mounting flange abuts the edge of said fuel tank opening and is sandwiched between said inner and outer plates.

3. The fuel tank of claim 2, wherein said mounting flange and said inner and outer plates include a plurality of fastener holes for receipt of fasteners to fasten said mounting flange and said edge of said fuel tank opening between said inner and outer plates.

4. The fuel tank of claim 3, wherein said inner plate includes fastener receiving means adjacent said fastener holes.

5. The fuel tank of claim 4, wherein said fasteners are self tapping screws.

6. The fuel tank of claim 1, further including a fuel sensor extending into said tubular body portion.

7. A fuel cell for use in a fuel tank used in watercrafts having fuel injection engines, said fuel cell comprising;

a tubular body portion defining an interior chamber, said tubular body portion extending into said fuel tank and including a base portion closing the bottom of said tubular body portion, said tubular body portion including apertures for communicating fuel from within said fuel tank into said fuel cell to be retained within said tubular body portion;

said fuel cell having an open end opposite said base, said open end being adapted to receive at least a fuel pick-up line;

said fuel cell includes a mounting plate for mounting said fuel cell to said fuel tank;

said mounting plate includes inner and outer plates and said fuel cell includes a mounting flange at one end, said mounting flange being adapted to be received between said inner and outer plates;

said inner plate being adapted to be mounted to the inside of said fuel tank having an opening therein for receipt of said fuel cell and said outer plate being adapted to be mounted to the outside of said fuel tank and connected to said inner plate with said mounting flange and a portion of said fuel tank being sandwiched between said outer plate and said inner plate;

said outer plate including ports for receipt of pick-up and return fuel lines, said fuel pick-up and return lines being adapted to be mounted inside said fuel cell such that fuel drawn by said engine is drawn from within said fuel cell and fuel returned from said engine is returned to said fuel cell.

8. The fuel cell of claim 7, wherein said fuel cell includes four walls defining a generally rectangular cross section, said walls being generally aligned with the fore, aft, starboard, and port sides of said watercraft, at least one of said sides including an aperture for receiving fuel within said fuel cell.

9. The fuel cell of claim 7, wherein said fuel cell includes four walls defining a generally rectangular cross section, said watercraft having a fore, aft, starboard and port side, said walls being generally aligned with the fore, aft, starboard, and port sides of said watercraft, said fuel cell including said apertures in said starboard and port sides of said tubular body portion.

10. The fuel cell of claim 9, further including a small opening in at least one of said fore and aft walls adjacent said base for communicating fuel into said tubular body portion.

11. The fuel cell of claim 7, wherein said mounting plate includes ports for receipt of pick-up and return fuel lines, said fuel pick-up and return lines being mounted inside said fuel cell such that fuel drawn by said engine is drawn from within said fuel cell and fuel returned from said engine is returned to said fuel cell.

12. The fuel cell of claim 7, wherein said mounting flange and said inner and outer plates include a plurality of fastener holes for receipt of fasteners to fasten said mounting flange and said portion of said fuel tank between said inner and outer plates.

13. A fuel tank for use in watercrafts having fuel injection engines comprising:

a mounting assembly for mounting a fuel pick-up line and a fuel return line in said fuel tank, said fuel tank including a surface having an opening for receipt of said fuel lines, said mounting assembly being mounted about said opening and having an outer plate mounted to the exterior of said fuel tank about the outer periphery of said opening;

a sump assembly mounted between said outer plate and said fuel tank and extending into said fuel tank, said sump assembly having a tubular body portion and a mounting flange at one end, said mounting flange being adapted to be received between said outer plate and said fuel tank;

said tubular body portion having a base and four walls defining a generally rectangular cross section, said watercraft having a fore, aft, starboard and port side, said walls being generally aligned with the fore, aft, starboard, and port sides of said watercraft, said starboard and port sides of said tubular body including apertures for receiving fuel from within said fuel tank, said fuel being retained within said tubular body portion, at least one of said fore and aft walls having a small opening adjacent said base for receiving fuel into said tubular body portion;

said fuel pick-up and return lines being mounted inside said tubular body portion such that fuel drawn by said engine is drawn from within said tubular body and fuel returned to said fuel tank is returned to said tubular body.

14. The fuel tank of claim 13, wherein said mounting assembly includes an inner mounting plate mounted to said fuel tank at said opening, said outer mounting plate being mounted to said inner mounting plate and said mounting flange and fuel tank surface being sandwiched between said inner and outer plates.

15. The fuel tank of claim 13, further including a fuel sensor means mounted to said outer plate and extending into said tubular body portion.

16. The fuel tank of claim 14, wherein said inner and outer plates are fastened together by self tapping screws.

* * * * *